United States Patent [19]

Juan et al.

[11] Patent Number: 4,619,551

[45] Date of Patent: Oct. 28, 1986

[54] DEVICE FOR REMOVING DEGRADED CONCRETE

[75] Inventors: Hans Juan, la Conversion, Switzerland; Jan Å. Bjerngren, Sollentuna; Carl Å. Strömdahl, Stockholm, both of Sweden

[73] Assignee: Atlas Copco Aktiebolag, Nacka, Sweden

[21] Appl. No.: 711,967

[22] Filed: Mar. 14, 1985

[30] Foreign Application Priority Data

Mar. 27, 1984 [SE] Sweden ..... 8401687

[51] Int. Cl.[4] ..... E01C 23/10

[52] U.S. Cl. ..... 404/90; 299/17; 299/36

[58] Field of Search ..... 404/90; 175/422, 67; 299/16, 17, 36; 239/186, 185, 184; 173/43, 52

[56] References Cited

U.S. PATENT DOCUMENTS

| | | | |
|---|---|---|---|
| 2,064,660 | 12/1936 | Haas | 299/16 X |
| 2,655,408 | 10/1953 | Williams | 175/422 |
| 2,928,322 | 3/1960 | Spitzer | 173/43 X |
| 3,225,842 | 12/1965 | Roeschen | 173/43 X |
| 3,910,815 | 10/1975 | Shelor | 239/186 X |
| 4,081,200 | 3/1978 | Cheung | 299/17 |
| 4,193,635 | 3/1980 | Thiruvengadam et al. | 299/17 |
| 4,453,773 | 6/1984 | Toffolon | 173/52 X |

*Primary Examiner*—James A. Leppink
*Assistant Examiner*—Matthew Smith
*Attorney, Agent, or Firm*—Frishauf, Holtz, Goodman & Woodward

[57] ABSTRACT

A device for removing degraded concrete from a layer of concrete (11). The device includes a carrier (12) and a guide mechanism (13) on the carrier for guiding a nozzle device (14) along a path above the concrete layer. The nozzle device is provided with a noncavitating nozzle (16) which is inclined relative to the concrete layer such that the nozzle points in the direction of movement of the nozzle device for either direction of movement of the nozzle device.

2 Claims, 7 Drawing Figures

DEVICE FOR REMOVING DEGRADED CONCRETE

The present invention relates to a device for removing degraded concrete from a layer of concrete.

A prior art device of the above kind is shown in GB No. 2 027 776. That device utilizes an oscillating nozzle supplied with high pressure water for cutting concrete. The pivotal movement has the drawback that high pressure seals are needed. Another drawback is that the distance between the nozzle and the concrete layer varies so that the cutting efficiency of the jet decreases. A further drawback is the risk that particles which have been broken away accumulate in front of the surface to be impacted by the liquid jet because the jet operates substantially perpendicularly to the surface being cut. This risk is partly done away with if the pivotal movement is fairly rapid.

The present invention, which is defined in the appended claims, aims at achieving a device for removing degraded concrete from a layer of concrete, which has an uncomplicated buildup and is efficient in operation. The high capacity of the device is obtained by inclining a nozzle, which emits a liquid jet, relative to the layer of concrete from which degraded concrete is to be removed and pointing the nozzle in the direction of movement of the nozzle. The direction of the nozzle is adjustable so that the jet attacks the material to be removed in both directions of movement of the nozzle. High capacity of the device is also obtained if a concavitating nozzle, i.e. a nozzle which generates a cavitation-free fluid flow, is inclined at a fixed angle in the range of 30°-60° relative to the concrete layer. The use of a fixed angle means that the distance between the nozzle and the concrete layer is constant during operation. The capacity as regards the removal of degraded concrete and the exposure and cleaning of reinforcing bars becomes particularly high if the angle of inclination is in the range of 30°-60° relative to the concrete layer and is attacking the concrete in both directions of movement of the nozzle.

The invention is exemplified with reference to the accompanying drawings in which FIG. 1 shows a side view of a device according to the invention.

Figure 1:
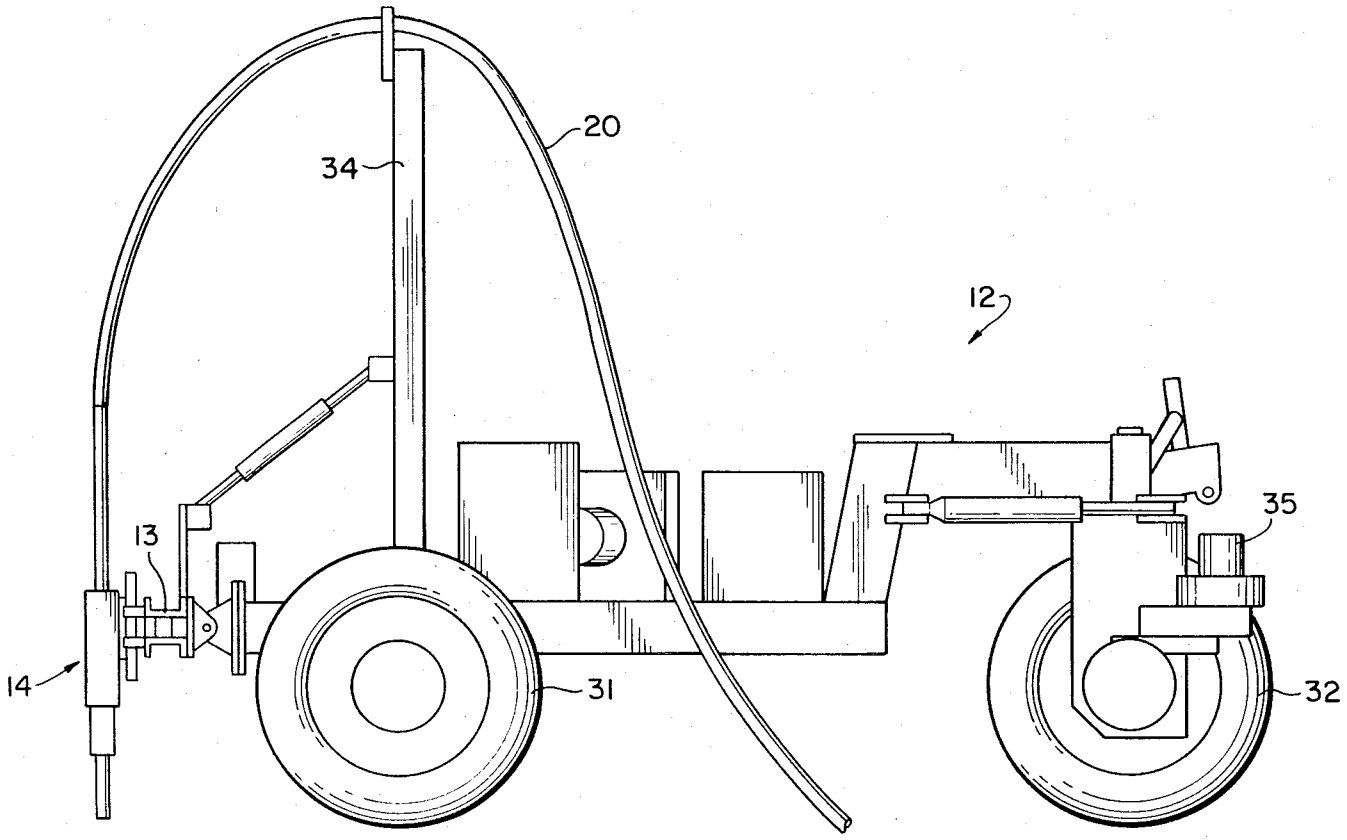

The device shown in the drawings is intended for removing degraded concrete from a layer of concrete 11 of a road surface, e.g. on a bridge. However, the idea of the invention can be used on any layer of concrete such as buildings or nuclear power plants. The device comprises a carrier 12 provided with means 13 for guiding a nozzle device 14 along a predetermined path at a substantially constant distance above the concrete layer 11. Means 13 is in the drawings shown as an elongated guide but could also be a swinging arm. If a swinging arm is used it should be sufficiently long so that the path of the nozzle device does not deviate too much from a straight line because a too curved path would result in uneven cutting depth of the liquid jet emitted by the nozzle device. Nozzle device 14 is by means of a flexible conduit 20 connected to a source 15 of high pressure liquid. The inlet of high pressure pump 15 is connected to a liquid container 37. The flexible conduit is supported by a support 34 on the carrier 12. The carrier is provided with three wheels 31,32,33. Wheel 32 is rotatable to drive the carrier by means of a motor 35. In order to drive the carrier a predetermined distance a sensor 36 is provided to sense the angle of rotation of one of the wheels. The elongated guide 13 is provided with sensors 22, preferably adjustably mounted on the guide, for sensing the end of a working stroke of the nozzle device 14. The nozzle device is driven along guide 13 by a not shown motor until a sensor 22 is activated. Upon actuation the driving direction is reversed.

Figure 2:
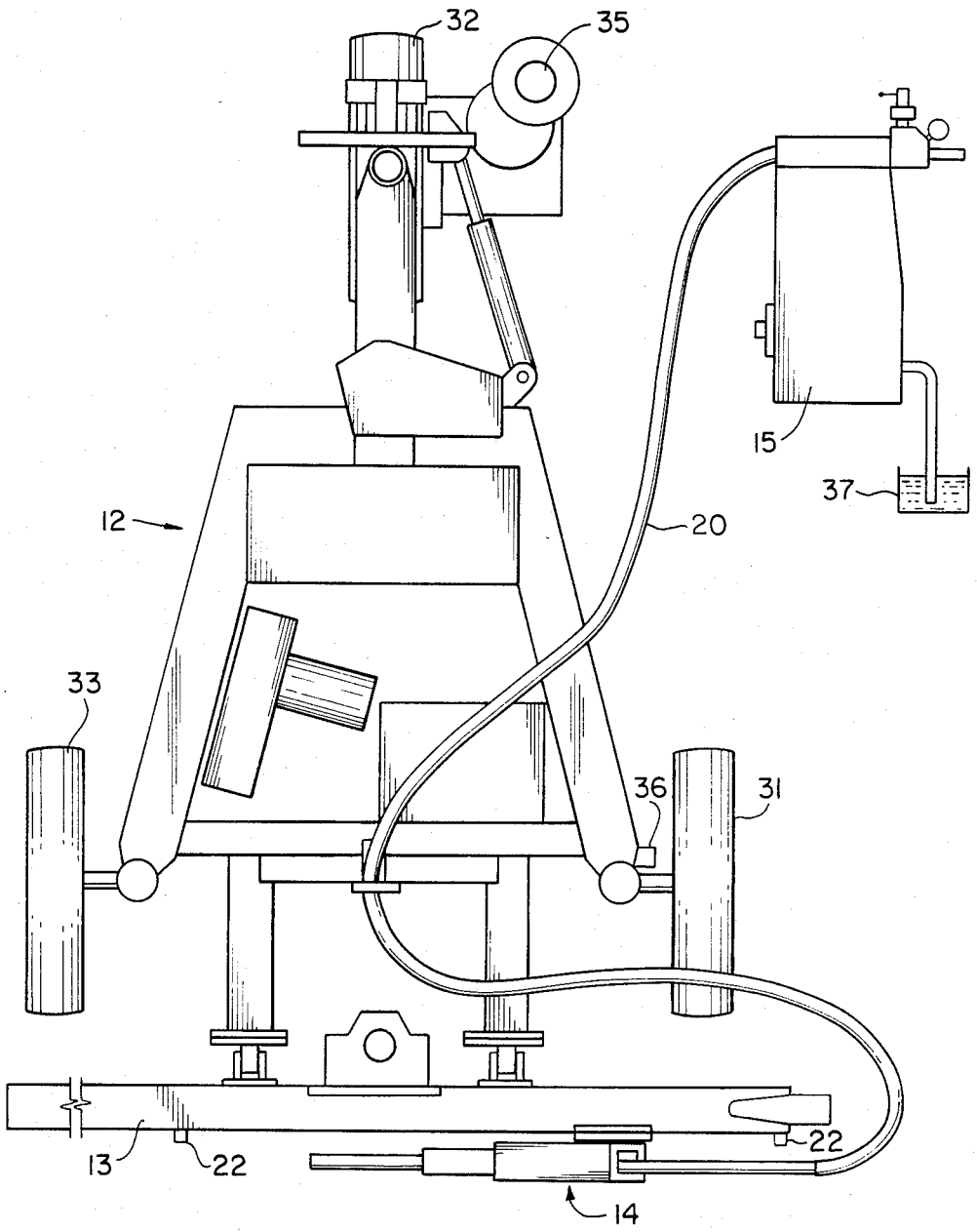
FIG. 2 shows a view from above of the device.

The device shown in FIGS. 1 and 2 utilizes a nozzle device which is inclined relative to the concrete layer at a fixed angle v in the range of 30°-60°. This device works more or less only when the nozzle device moves to the left in FIG. 2, i.e. when the nozzle of the nozzle device points in the direction of movement of the nozzle device.

Figure 3:
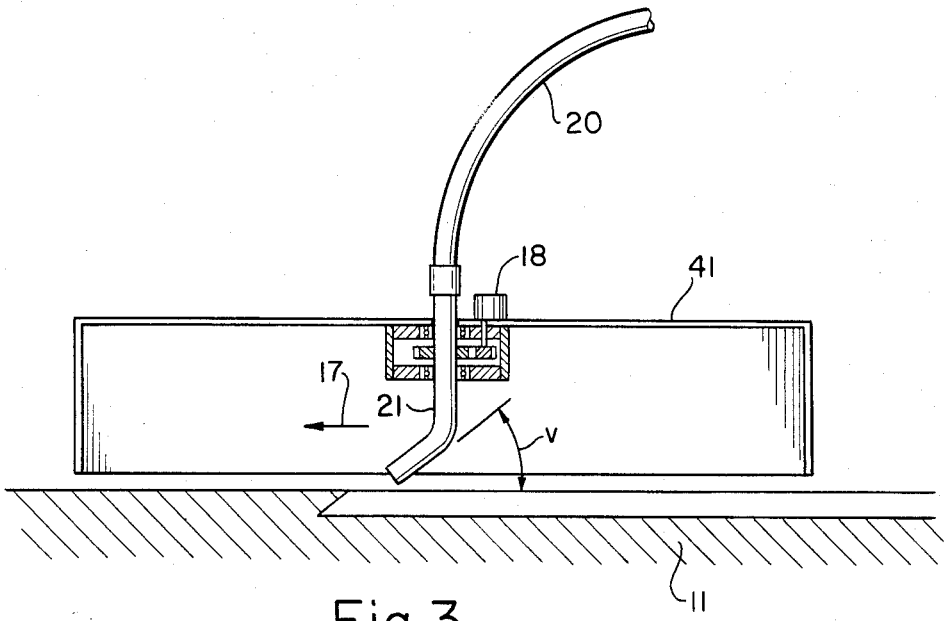
FIG. 3 shows a detail of the device.
Figure 4:
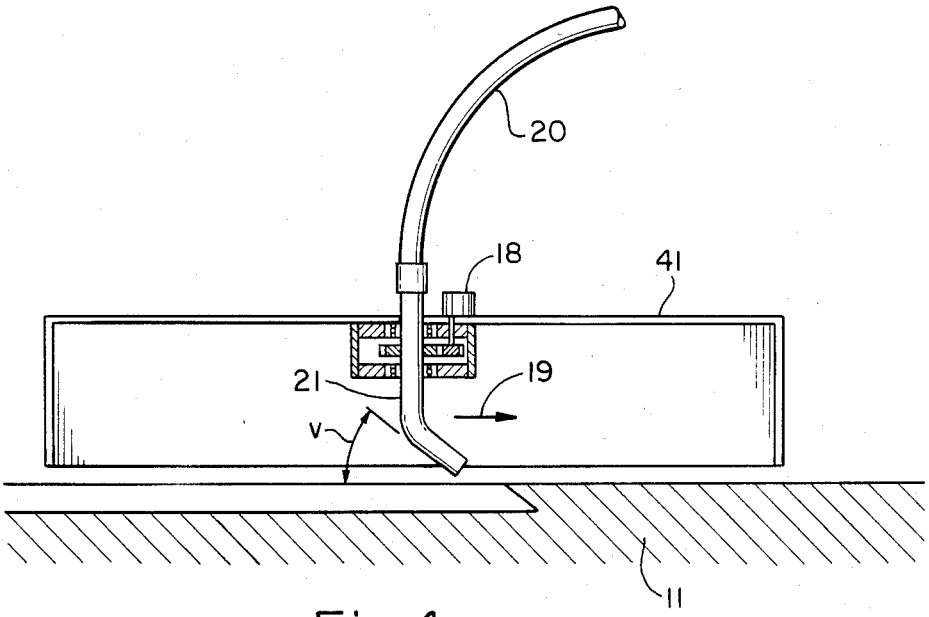
FIG. 4 shows the detail of FIG. 3 in another position.
Figure 5:
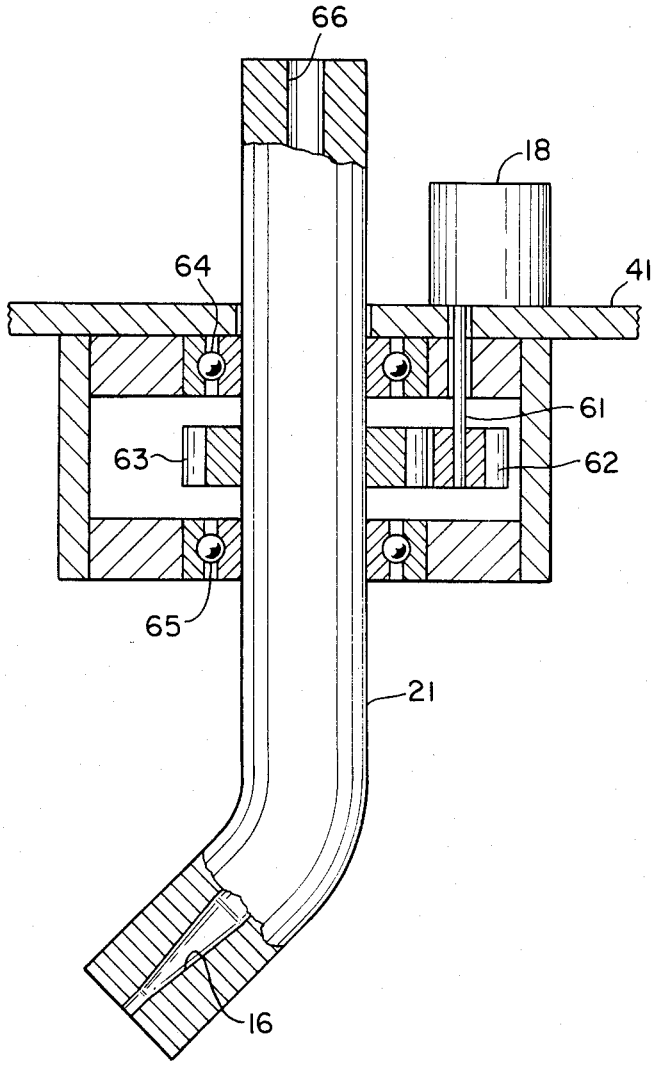
FIG. 5 shows on a larger scale the adjustable nozzle of FIGS. 3 and 4.

The embodiment shown in FIGS. 3-5 uses a nozzle device with an adjustable nozzle 16 the axis of which points in the direction of movement of the nozzle device both when the nozzle device moves in a first direction 17 and in a second opposite direction 19. The direction of the nozzle is adjusted by a motor 18. The movements caused by this adjustment are taken up by the flexible conduit 20. The nozzle device is provided with a shield 41 mounted on guide 13. Nozzle 16 is provided at one end of a bent tube 21. The other end is connected to the flexible conduit. High pressure liquid is supplied through a channel 66 to nozzle 16. The bent tube is journalled in bearings 64,65 and provided with a gear 63 which cooperates with a gear 62 on shaft 61 of motor 18. Nozzle 16 is a noncavitating nozzle by which is meant that the jet downstream of the nozzle contains substantially no bubbles which could cause cavitation.

Figure 6:
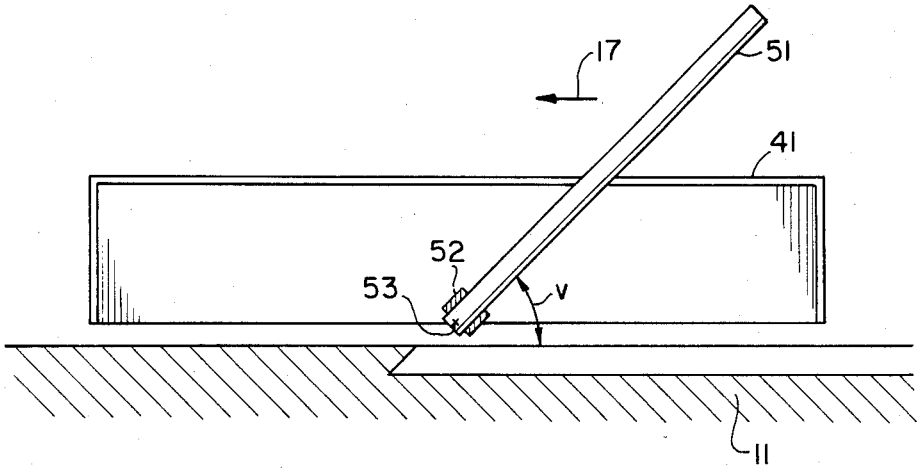
FIGS. 6 and 7 show another embodiment of the detail of FIGS. 3 and 4.
Figure 7:
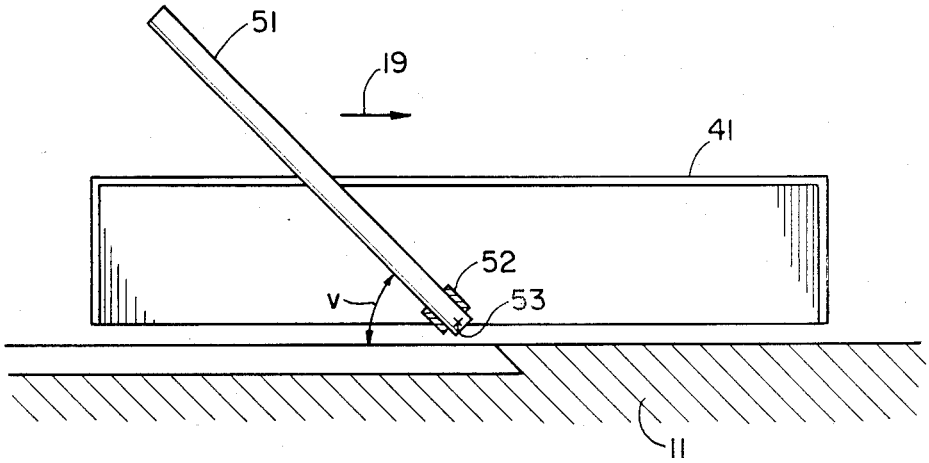

The embodiment shown in FIGS. 6 and 7 comprises a tube 51 being provided with a nozzle at its lower end. The tube is held in a holder 52. The holder is connected to shield 41 such that the tube can be rotated about axis 53.

The shown device works in the following way. Liquid is supplied from liquid container 37 by high pressure pump 15 through the flexible conduit 20 to nozzle device 14. Nozzle 16 of nozzle device 14 emits a jet which impinges concrete layer 11. The direction of the jet results in the breaking away of pieces of substantial size of the concrete layer. When the end of the working stroke of the nozzle device is sensed by sensor 22, motor 35 is activated to drive the carrier 12 a predetermined distance, of the order of 3-10 cm. Motor 35 is stopped when sensor 36 indicates that the distance has been traversed. The nozzle is then adjusted if adjustable and the direction of movement of the nozzle device is reversed. The same procedure is then repeated each time a sensor 22 senses the end of the path of movement of the nozzle device.

We claim:

1. A device for removing degraded concrete from the surface of a concrete layer, comprising:

a carrier constructed for movement over the concrete layer;

a source of high-pressure fluid associated with said carrier;

a nozzle guide assembly disposed on said carrier;

a nozzle device including a non-cavitating nozzle fixed to said guide assembly and in fluid communication with said high-pressure fluid source, wherein the nozzle guide assembly guides said nozzle device along a predetermined path at a substantially constant distance above the concrete layer while a high-pressure fluid jet from said non-cavitating nozzle impacts the surface of the concrete layer;

said nozzle device including means for supporting said non-cavitating nozzle so that the axis of the nozzle is inclined at a fixed angle in the range of 30° to 60° relative to the concrete layer and said nozzle points in the direction in which it is guided by said guide assembly;

wherein accumulation of already dislodged surface particles in front of the surface to be impacted by said high-pressure fluid jet is substantially reduced relative to accumulation of said particles when the nozzle axis is perpendicular to the concrete layer.

2. A device according to claim 1, wherein said nozzle guide assembly includes sensor means for detecting the end of a working stroke of said nozzle device, and said carrier includes motor means for moving said carrier a certain distance over the concrete layer in response to an output from said sensor means after which movement a subsequent working stroke of said nozzle device can be made.

* * * * *